US009782627B1

(12) United States Patent
Peterson

(10) Patent No.: US 9,782,627 B1
(45) Date of Patent: Oct. 10, 2017

(54) HAND-HELD PADDLE APPARATUSES AND METHODS OF USING THE SAME

(71) Applicant: Zachary Allen Peterson, Rockford, IL (US)

(72) Inventor: Zachary Allen Peterson, Rockford, IL (US)

( * ) Notice: Subject to any disclaimer, the term of this patent is extended or adjusted under 35 U.S.C. 154(b) by 0 days.

(21) Appl. No.: 15/248,894

(22) Filed: Aug. 26, 2016

(51) Int. Cl.
*A63B 31/04* (2006.01)
*A63B 31/08* (2006.01)

(52) U.S. Cl.
CPC ..... *A63B 31/04* (2013.01); *A63B 31/08* (2013.01)

(58) Field of Classification Search
CPC ..... A63B 31/04; A63B 31/08
USPC ..... 441/57
See application file for complete search history.

(56) References Cited

U.S. PATENT DOCUMENTS 4,516,774 A * 5/1985 Nankivell ..... A63B 60/40 473/518
4,521,011 A * 6/1985 Solloway ..... A63B 21/0084 441/59
5,304,080 A * 4/1994 Dilger ..... A63B 31/08 416/72
5,376,036 A * 12/1994 Hull ..... A63B 31/04 441/58
5,511,998 A * 4/1996 Johnson ..... A63B 31/10 441/56
5,516,319 A * 5/1996 Nessel ..... A63B 31/08 441/56
7,179,146 B2 * 2/2007 Johnson ..... A63B 31/10 441/56
7,494,395 B2 * 2/2009 Krikliwy ..... A63B 31/10 441/56
D777,866 S * 1/2017 Mckee ..... A63B 31/10 D21/807
2009/0280703 A1 * 11/2009 Rachels ..... A63B 31/02 441/57
2011/0165804 A1 * 7/2011 Wenzel ..... A63B 31/10 441/58
2015/0072579 A1 * 3/2015 Jack ..... A63B 69/00 441/57

* cited by examiner

*Primary Examiner* — Lars A Olson
*Assistant Examiner* — Jovon Hayes
(74) *Attorney, Agent, or Firm* — Scherrer Patent & Trademark Law, P.C.; Stephen T. Scherrer; Monique A. Morneault

(57) ABSTRACT

Hand-held paddle apparatuses are useful for moving a body through a fluid, such as water, and providing use of hands and fingers for other functions. Moreover, the hand-held paddle apparatuses are hinged to reduce the surface area interacting with the fluid when the paddle apparatuses move in one direction, and to open to increase the surface area interacting with the fluid in an opposite direction.

18 Claims, 4 Drawing Sheets

HAND-HELD PADDLE APPARATUSES AND METHODS OF USING THE SAME

TECHNICAL FIELD

The present invention relates to hand-held paddle apparatuses. Specifically, the hand-held paddle apparatuses are useful for moving a body through a fluid, such as water, and providing use of hands and fingers for other functions. Moreover, the hand-held paddle apparatuses are hinged to reduce the surface area interacting with the fluid when the paddle apparatuses move in one direction, and to open to increase the surface area interacting with the fluid in an opposite direction.

BACKGROUND

It is, of course, generally known to utilize paddles and flippers to enable a user to move through a fluid, such as, for example, an amount of water. Indeed, water flippers, otherwise known as swim fins, are finlike accessories that are typically worn on the foot or leg and made from rubber, plastic or combinations of these materials, to aid movement through the water in water sports activities such as swimming, bodyboarding, bodysurfing, knee boarding, river boarding, underwater hockey, underwater rugby and various other types of underwater diving.

Swim fins generally help the wearer to move through water more efficiently, as human feet are typically too small and inappropriately shaped to provide much thrust, especially when the wearer is carrying equipment that increases hydrodynamic drag. Very long fins and monofins used by freedivers as a means of underwater propulsion do not require high frequency leg movement. This improves efficiency and helps to minimize oxygen consumption. Short, stiff-bladed fins are effective for short bursts of acceleration and maneuvering, and are useful for bodysurfing.

Swim fins were proposed by Leonardo Da Vinci and Benjamin Franklin. It was not until 1914 that the first practical demonstration of a pair of swim fins was made by inventor Louis de Corlieu, a captain in the French Navy. Variations of the first swim fins developed over the years, and today swim fins come in many types of shapes and sizes, and are made from various materials, depending on their application.

Swim fins, as noted above, are generally worn on the legs and/or feet. As such, they are used to propel a wearer in one direction by kicking against the fluid in the opposite direction. Wearers use scissor kicks, frog kicks, or dolphin kicks for propulsion. Typically, swim fins are not required to move against the direction of desired motion.

When a person is swimming through water, his hands and arms typically move differently than the legs and feet. Legs and feet generally move back-and-forth or in a kicking motion, and generally do not have to move against the movement of the fluid. However, a swimmer must rotate their arms in order to get the hands into a position to aid in pushing the body through the water. This means that the hands and arms must typically move in the direction of movement, and against the fluid. A swimmer tends to minimize the surface area of his or her hands when moving them in the direction of movement to minimize the interaction of the surface area of the hands against the fluid.

Heretofore, swim fins are not generally suitable for use on a wearer's hands because swim fins typically have a surface area that cannot be easily or readily changed when swim fins are moving against the fluid in which the wearer is moving.

Thus, swim fins have not heretofore been adapted for hands to be used in the same manner as they are used on legs and/or feet.

Swimming gloves are known that aid a wearer in moving through a fluid such as water. Swim gloves typically have individual fingers with webbing therebetween. When a wearer moves his or her hand against the fluid, the wearer can keep the fingers close together to minimize the surface area. When the wearer moves his or her hand with the fluid to provide further propulsion through the fluid, the user can open his or her fingers to increase the interaction of the fluid on the webbing. However, while swim gloves can provide some propulsion, the webbing provided does not typically provide a large amount of surface area to interact with the fluid through which a wearer is moving, so the amount of propulsion is fairly minimal. In addition, in some cases, in order to increase the surface area, the webbing and other features on the gloves are increased, or made stiffer, which decreases the wearer's ability to use his or her fingers and hands for other functions without removing the gloves.

A need, therefore, exists for hand-held paddle apparatuses to aid a wearer in moving his or her body through a fluid, such as water. Moreover, a need exists for hand-held paddle apparatuses that may be worn on a user's hand and may be easily removed when desired.

Further, a need exists for hand-held paddle apparatuses that may be useful to move a wearer through a fluid, but does not impede a wearer from moving through the fluid when the hands are moved against the fluid. Still further, a need exists for hand-held paddle apparatuses that provide increased surface area when the paddle apparatuses move in the direction of the fluid movement, and provide decreased surface area when the paddle apparatuses move against the direction of the fluid movement, thereby maximizing propulsion against the fluid, and minimizing drag with the fluid.

In addition, a need exists for hand-held paddle apparatuses that may provide for unrestricted movement and use of the hands and, more specifically, the fingers of the wearer's hands when being worn. Specifically, a need exists for hand-held paddle apparatuses that allow a user to use his or her hands for other functions, such as holding other items, when wearing the paddle apparatuses.

SUMMARY OF THE INVENTION

The present invention relates to hand-held paddle apparatuses. Specifically, the hand-held paddle apparatuses are useful for moving a body through a fluid, such as water, and providing use of hands and fingers for other functions. Moreover, the hand-held paddle apparatuses are hinged to reduce the surface area interacting with the fluid when the paddle apparatuses move in one direction, and to open to increase the surface area interacting with the fluid in an opposite direction.

To this end, in an embodiment of the present invention, a hand-held paddle apparatus is provided. The hand-held paddle apparatus comprises a paddle body comprising a first end and a second end, the first end of the paddle body comprising a wrist strap configured to allow a wearer's arm to be disposed therethrough, and at least one finger aperture positioned between the first end and the second end configured to allow at least one of the wearer's fingers to be disposed therethrough, and a paddle portion extending from the paddle body at the second end.

In an embodiment, the hand-held paddle apparatus further comprises a plurality of finger apertures positioned between the first end and the second end configured to allow a plurality of the wearer's fingers to be disposed therethrough.

In an embodiment, the hand-held paddle apparatus further comprises a foldable element disposed between the first end and the second end of the paddle body configured to allow the second end to fold toward the first end.

In an embodiment, the foldable element comprises a hinge.

In an embodiment, the foldable portion comprises a flexible foldable material.

In an embodiment, the foldable portion is configured to allow the second end to fold toward the first end when the wearer's fingers bend toward the wearer's palm.

In an embodiment, the second end has a shape selected from the group consisting of a shark fin, a frog foot, and a duck foot.

In an embodiment, the paddle body is a flexible material.

In an embodiment, the paddle body comprises an elastomeric rubber.

In an embodiment, the paddle body further comprises a thumb portion disposed in proximity to the finger aperture.

In an alternate embodiment of the present invention, a method of using a hand-held paddle apparatus is provided. The method comprises the steps of: providing a paddle body comprising a first end and a second end, the first end of the paddle body comprising a wrist strap configured to allow a wearer's arm to be disposed therethrough, and at least one finger aperture positioned between the first narrow end and the second broad end configured to allow at least one of the wearer's fingers to be disposed therethrough; and disposing a user's hand and arm through the wrist strap and engaging at least one finger of the user's hand through the finger aperture.

In an embodiment, the method further comprises the step of: providing a plurality of finger apertures positioned between the first end and the second end configured to allow a plurality of the wearer's fingers to be disposed therethrough.

In an embodiment, the method further comprises the steps of: providing a foldable element disposed between the first end and the second end of the paddle body configured to allow the second end to fold toward the first end; and folding the first end of the paddle body toward the first end of the paddle body.

In an embodiment, the foldable element comprises a hinge.

In an embodiment, the foldable portion comprises a flexible foldable material.

In an embodiment, the foldable portion is configured to allow the second end to fold toward the first end when the wearer's fingers bend toward the wearer's palm.

In an embodiment, the second end has a shape selected from the group consisting of a shark fin, a frog foot, and a duck foot.

In an embodiment, the paddle body is a flexible material.

In an embodiment, the paddle body comprises an elastomeric rubber.

In an embodiment, the paddle body further comprises a thumb portion disposed in proximity to the finger aperture.

It is, therefore, an advantage and objective of the present invention to provide hand-held paddle apparatuses to aid a wearer in moving his or her body through a fluid, such as water.

Moreover, it is an advantage and objective of the present invention to provide hand-held paddle apparatuses that may be worn on a user's hand and may be easily removed when desired.

Further, it is an advantage and objective of the present invention to provide hand-held paddle apparatuses that may be useful to move a wearer through a fluid, but does not impede a wearer from moving through the fluid when the hands are moved against the fluid.

Still further, it is an advantage and objective of the present invention to provide hand-held paddle apparatuses that provide increased surface area when the paddle apparatuses move in the direction of the fluid movement, and provide decreased surface area when the paddle apparatuses move against the direction of the fluid movement, thereby maximizing propulsion against the fluid, and minimizing drag with the fluid.

In addition, it is an advantage and objective of the present invention to provide hand-held paddle apparatuses that may provide for unrestricted movement and use of the hand and, more specifically, the fingers of the wearer's hands when being worn.

Specifically, it is an advantage and objective of the present invention to provide hand-held paddle apparatuses that allow a user to use his or her hands for other functions, such as holding other items, when wearing the paddle apparatuses.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to hand-held paddle apparatuses. Specifically, the hand-held paddle apparatuses are useful for moving a body through a fluid, such as water, and providing use of hands and fingers for other functions. Moreover, the hand-held paddle apparatuses are hinged to reduce the surface area interacting with the fluid when the paddle apparatuses move in one direction, and to open to increase the surface area interacting with the fluid in an opposite direction.

Now referring to the figures, wherein like numerals refer to like parts, FIG. 1 illustrates a perspective view of a hand-held paddle apparatus 10 for use by a user when swimming. The hand-held paddle apparatus 10 aids a user in propelling a user through the water using a swim stroke. In an embodiment, the hand-held paddle apparatus 10 may be used in conjunction with foot flippers that further allow a user to propel him or herself through the water.

Figure 1A:
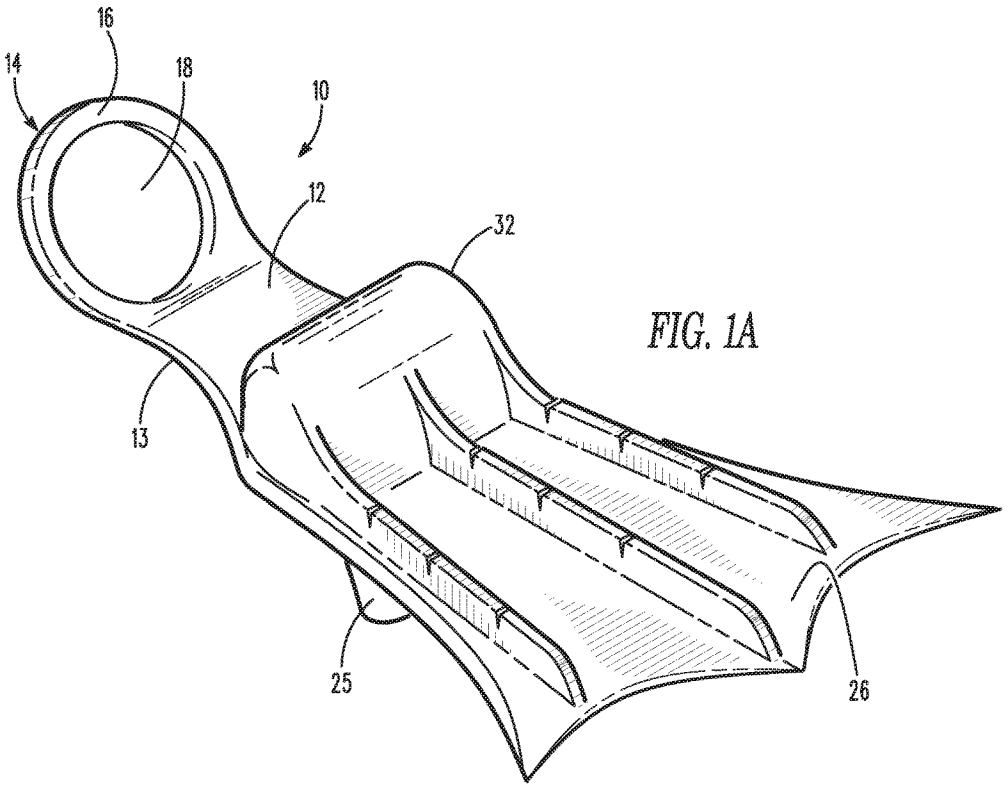
FIGS. 1A-1B illustrate perspective views of a hand-held paddle apparatus in an embodiment of the present invention.
Figure 1B:
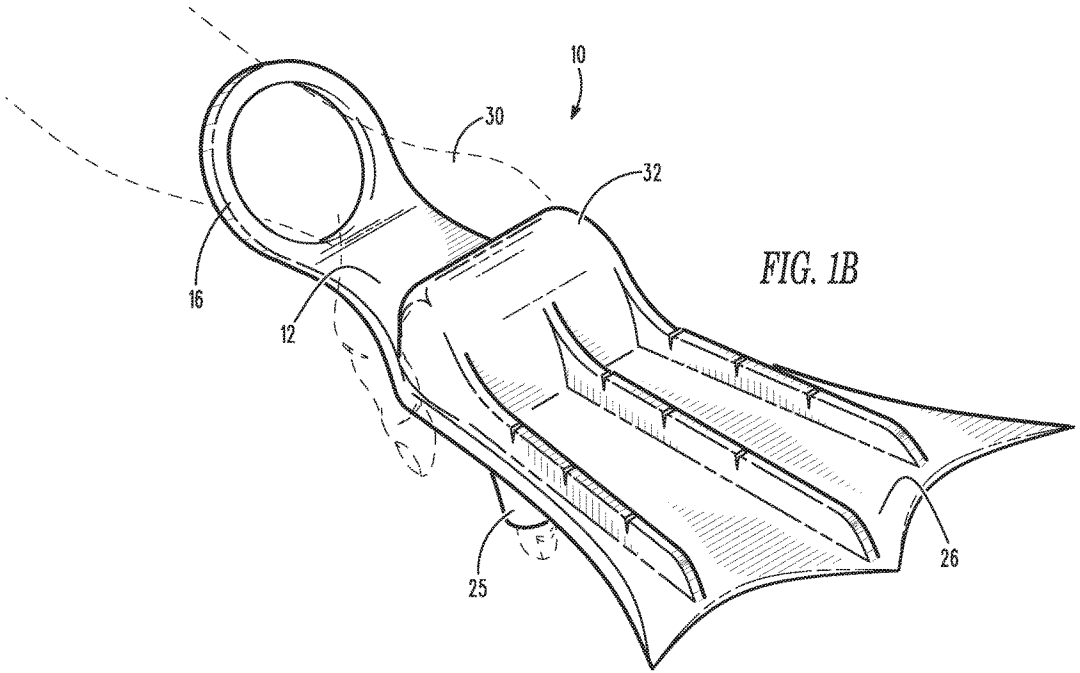
Figure 2:
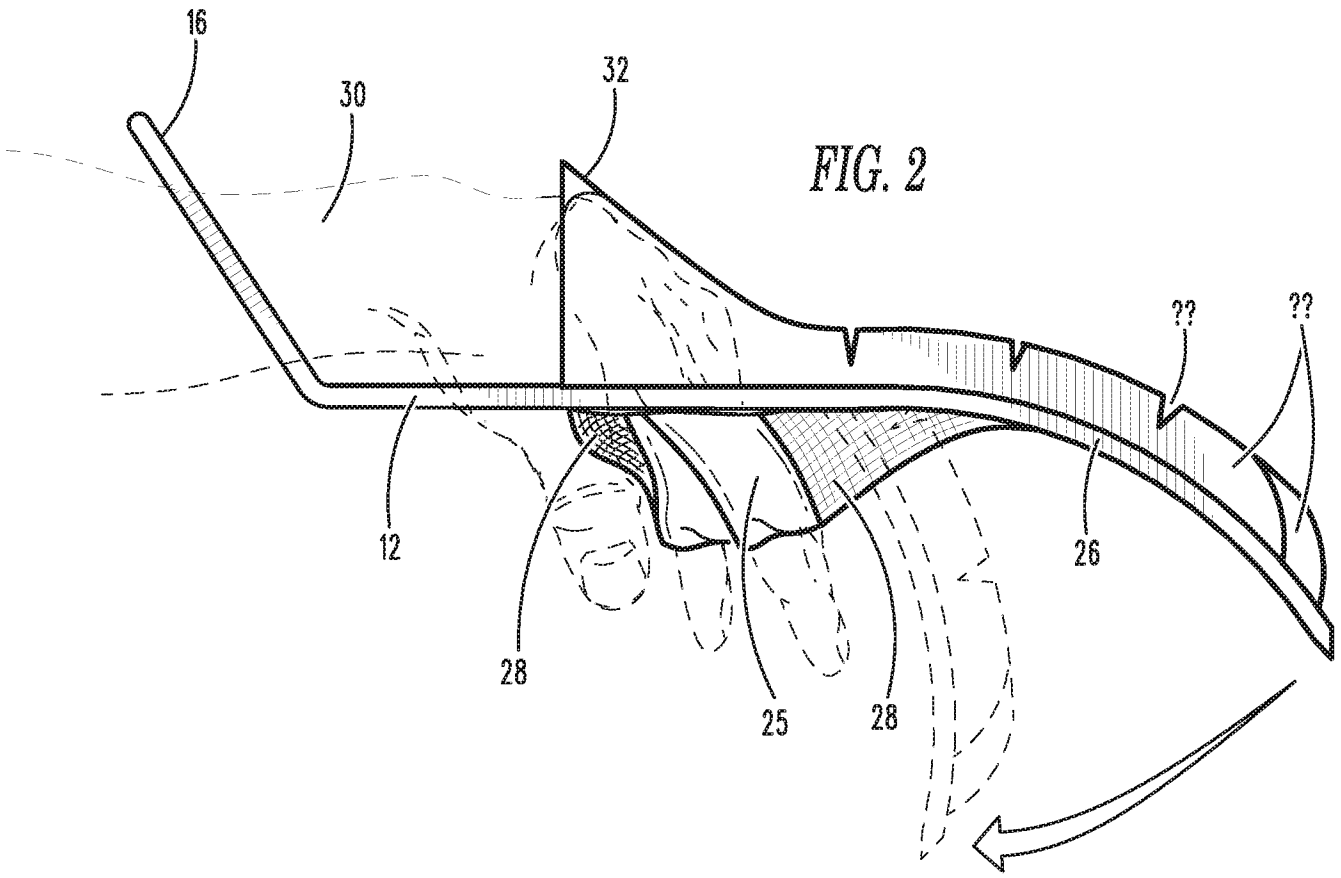
FIG. 2 illustrates a side-view of a hand-held paddle apparatus in an embodiment of the present invention.

The hand-held paddle apparatus 10 preferably comprises a palmar portion 12 comprising a strip of material that is positioned, as illustrated in FIGS. 1B and 2, over the palm of a user. On a first end 14 may be a wrist strap 16 comprising a wrist hole 18 that a user may dispose his or her hand through, wherein the wrist strap 16 may be positioned over a user's wrist or forearm as illustrated in FIGS. 1B and 2. A fold line or flexible area 19 may be positioned between the wrist strap 16 and the palmar portion 12 to allow the wrist strap 16 to be positioned to allow a user to dispose his or her hand and arm therethrough, as illustrated in FIGS. 1B and 2. The palmar portion 12 may further have a thumb portion 13 providing a region allowing exposure of the user's thumb.

Adjacent the palmar portion 12 of the paddle apparatus 10 may be a hand cover 32 having an aperture therein that may allow a user to dispose a portion of his or her hand 31 and/or his or her fingers therethrough, as illustrated in FIGS. 1B and 2. One or more finger sleeves 25 may extend from the hand cover 32 beneath the apparatus 10 that may hold a user's fingers when disposed therethrough. The finger sleeves 25 may be full finger sleeves, extending over the entirety of the terminal end of the user's fingers. Alternatively, the finger sleeves 25 may be cut-off, as illustrated in FIGS. 1A, 1B and 2 that may allow a user's fingers to extend therethrough so that the terminal ends of the user's fingers may be exposed and useable for other purposes.

Extending from the palmar portion 12 may be a wide paddle portion 26 that may catch the water and aid a user in propelling him or herself through the water. The paddle portion 26 may be shaped to catch water to allow a user to propel him or herself through the water. The paddle portion 26 may be any shape for that purpose, and may be uniquely shaped to mimic an animal's parts, such as a shark fin, a frog's foot, or a duck's foot.

The paddle portion 26 may comprise one or more reinforcement spines 28 that may extend from hand cover 32 to or near the terminal end of the paddle portion 26 on a top thereof or integrally formed within the paddle portion 26. The one or more reinforcement spines 28 may provide reinforcement of the paddle portion 26, especially when the paddle portion 26 moves against a fluid, such as when the paddle apparatus 10 is worn on a user's hand to propel the user through a fluid, such as water.

The one or more reinforcement spines 28 may further have one or more hinge elements 30 disposed therein to allow the paddle portion to fold in strategic locations. For example, as illustrated in FIGS. 1A, 1B and 2, the paddle apparatus comprises three reinforcement spines 28, each containing hinges 30 in locations that allow the spines 28 to fold. As illustrated in FIG. 2, the paddle portion 26 may fold downwardly via the hinges 28. However, the hinges 28 prevent the paddle portion 26 from folding upwardly when the paddle portion 26 reaches its fully extended and relatively flattened configuration, as illustrated in FIGS. 1A and 1B.

The hand-held paddle apparatus 10 may be made from any material useful for its purpose, including plastic, metal, wood, composite materials, other like materials, or any combination thereof. Preferably, the hand-held paddle apparatus 10 may be made from an elastomeric material that may be relatively soft, yet sturdy and resilient. Further, the paddle portion 26 may be made from a flexible material that easily folds, especially as the hinges 30 allow the one or more reinforcement spines to fold at the hinges 30, thereby allowing the entirety of the paddle portion 26 to fold therewith.

FIG. 1B illustrates a user's wrist 30 and hand 31 engaged with the hand-held paddle apparatus 10, such as during use in water. When a user flexes his or her hand 31 and fingers, the paddle portion 26 may bend at the hinges 30 and the paddle portion 26 may fold downwardly, as needed. When a user straightens his or her hand 31 and fingers, the paddle portion 26 may extend and flatten, and the hinges 30 may prevent the paddle portion 26 from folding upwardly. Thus when a user wishes to catch water and aid in propulsion, the user may extend his or her hand, extending the paddle portion 26 fully to catch the water. When a user wishes to cut his or her hand through the water, he or she may fold his or her hand and fingers, thereby folding the paddle portion 26 to streamline the hand-held paddle apparatus 10, as illustrated in FIG. 2.

FIG. 2 illustrates a side view of a hand-held paddle apparatus 10 showing, in phantom, a user's hand 31 disposed through the wrist strap, with the palmar portion 12 disposed over the palm of the user's hand 31. The user's fingers are disposed through the hand cover 32. The fingers of the user's hand 31 may extend through finger sleeves 25 that may be further connected to the paddle portion 26 via webbing 34 or other reinforcing material.

The webbing 34 may extend from the finger sleeves 25 and connect on an underside of the paddle portion 26 longitudinally on the paddle portion 26 toward the terminal end thereof. The webbing 34 may thereby link the finger sleeves 25 to the paddle portion, such that when the user flexes or bends his or her hand 31 and fingers, the paddle portion 26 may be pulled downwardly toward the palmar portion of the user's hand, thereby bending the paddle portion 26 at the hinges 30 of the reinforcement spines 28.

Figure 3:
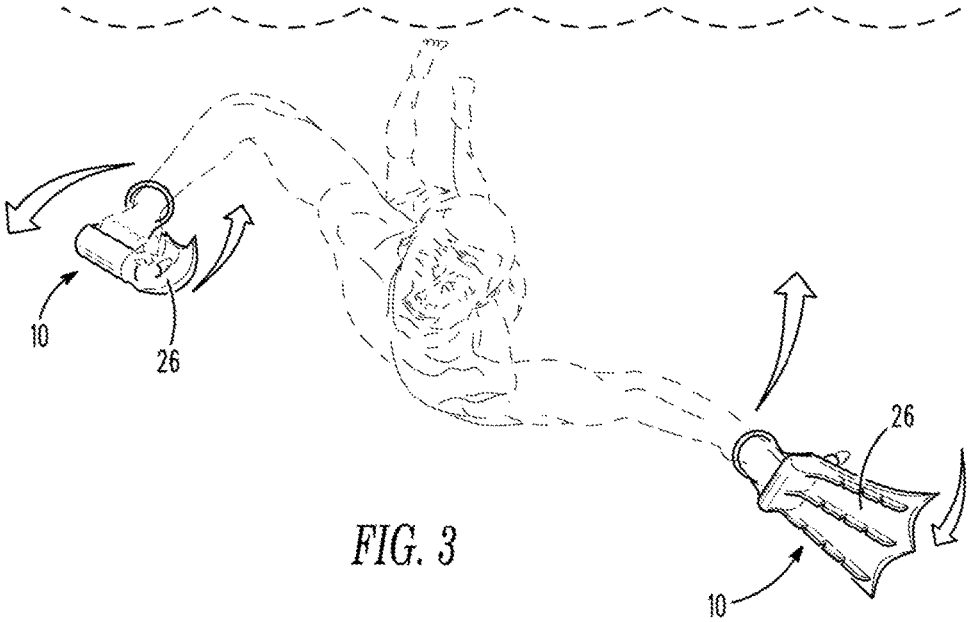
FIG. 3 illustrates a front view of a swimmer using a pair of paddle apparatuses in an embodiment of the present invention.

FIG. 3 illustrates a user using a pair of paddle apparatuses 10 in an embodiment of the present invention. A user's right and left hand may be engaged with the pair of paddle apparatuses 10 so that a user may propel him or herself through water when the user is swimming. The user's left hand is extended so that the paddle portion 26 is extended, allowing a user to catch the water as the user moves his hand from a forward position to a rear position. The user's right hand and fingers may be flexed or bent so that the paddle portion 26 is folded to streamline the hand-held paddle apparatus 10 so that a user may more easily move his or her hand from a rear position to a forward position. Once at the forward position, the user may open his or her hand, thereby extending the paddle portion 26 to the extended position, allowing the user to catch the water as the user moves his or her hand from the forward position to the rearward position, completing the cycle.

Figure 4:
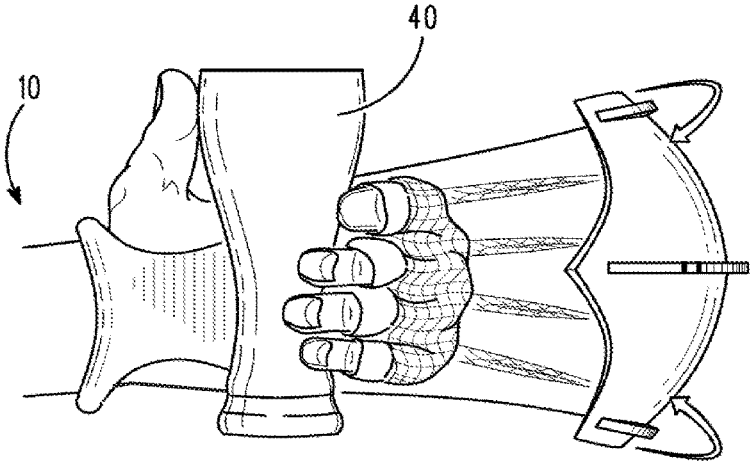
FIG. 4 illustrates a bottom view of a hand-held paddle apparatus in use by a user holding a beverage in an embodiment of the present invention.

FIG. 4 illustrates a user engaged with a hand-held paddle apparatus 10, further illustrating how a user has freedom to utilize his or her fingers even while his or her hand is engaged in the hand-held paddle apparatus 10. The user's fingers and thumb may be exposed, allowing the fingers to be utilized for other purposes, such as for holding a glass or a can 40 of a beverage. Because the fingers of the user's hand are bent, the paddle portion 26 is consequently bent toward the user's palmar portion, as shown.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element that is not specifically disclosed herein.

I claim:

1. A hand-held paddle apparatus comprising:

a paddle body comprising a first end and a second end, the first end of the paddle body comprising a wrist strap configured to allow a wearer's arm to be disposed therethrough, and at least one finger aperture positioned between the first end and the second end configured to allow at least one of the wearer's fingers to be disposed therethrough, and a paddle portion extending from the paddle body at the second end; and a folding element disposed between a first end and a second end of the paddle portion configured to fold the second end toward the first end.

2. The hand-held paddle apparatus of claim 1 further comprising:

a plurality of finger apertures positioned between the first end and the second end configured to allow a plurality of the wearer's fingers to be disposed therethrough.

3. The hand-held paddle apparatus of claim 1 wherein the folding element comprises a hinge.

4. The hand-held paddle apparatus of claim 1 wherein the folding element comprises a flexible foldable material.

5. The hand-held paddle apparatus of claim 1 wherein the folding element is configured to allow the second end to fold toward the first end when the wearer's fingers bend toward the wearer's palm.

6. The hand-held paddle apparatus of claim 1 wherein the second end has a shape selected from the group consisting of a shark fin, a frog foot, and a duck foot.

7. The hand-held paddle apparatus of claim 1 wherein the paddle body is a flexible material.

8. The hand-held paddle apparatus of claim 1 wherein the paddle body comprises an elastomeric rubber.

9. The hand-held paddle apparatus of claim 1 wherein the paddle body further comprises a thumb portion disposed in proximity to the finger aperture.

10. A method of using a hand-held paddle apparatus comprising the steps of:

providing a paddle body comprising a first end and a second end, the first end of the paddle body comprising a wrist strap configured to allow a wearer's arm to be disposed therethrough, and at least one finger aperture positioned between the first narrow end and the second broad end configured to allow at least one of the wearer's fingers to be disposed therethrough, and a paddle portion extending from the paddle body at the second end, and a folding element disposed between a first end and a second end of the paddle portion configured to fold the second end toward the first end;

disposing a user's hand and arm through the wrist strap and engaging at least one finger of the user's hand through the finger aperture;

folding the hand-held paddle apparatus at the folding element when swimming in water when the user's hand travels against a flow of the water; and unfolding the hand-held apparatus at the folding element when the user's hand travels with the flow of the water.

11. The method of claim 10 further comprising the steps of:

providing a plurality of finger apertures positioned between the first end and the second end configured to allow a plurality of the wearer's fingers to be disposed therethrough.

12. The method of claim 10 wherein the folding element comprises a hinge.

13. The method of claim 10 wherein the folding element comprises a flexible foldable material.

14. The method of claim 10 wherein the folding element is configured to allow the second end of the paddle portion to fold toward the first end when the wearer's fingers bend toward the wearer's palm.

15. The method of claim 10 wherein the second end has a shape selected from the group consisting of a shark fin, a frog foot, and a duck foot.

16. The method of claim 10 wherein the paddle body is a flexible material.

17. The method of claim 10 wherein the paddle body comprises an elastomeric rubber.

18. The method of claim 10 wherein the paddle body further comprises a thumb portion disposed in proximity to the finger aperture.

* * * * *